US005391830A

United States Patent [19]

Nishino et al.

[11] Patent Number: 5,391,830

[45] Date of Patent: Feb. 21, 1995

[54] FOOT PEDAL CONTROL SYSTEM INCORPORATED IN MUSICAL INSTRUMENT AND SHARED BETWEEN ANALOG SIGNAL AND DIGITAL SIGNAL

[75] Inventors: Toshihiro Nishino; Rei Furukawa; Takashi Tamaki, all of Shizuoka, Japan

[73] Assignee: Yamaha Corporation, Japan

[21] Appl. No.: 66,885

[22] Filed: May 25, 1993

[30] Foreign Application Priority Data

May 28, 1992 [JP] Japan ..... 4-162094

[51] Int. Cl.[6] ..... G10H 1/02; G10H 1/18; G10H 1/38

[52] U.S. Cl. ..... 84/626; 84/658; 84/721

[58] Field of Search ..... 84/603, 609, 611, 612, 84/626, 634, 635, 649, 651, 652, 658, 667, 668, 687, 690, 712–714, 718, 721, 738, 746

[56] References Cited

U.S. PATENT DOCUMENTS

| | | | |
|---|---|---|---|
| 4,095,501 | 6/1978 | Aoki | 84/652 |
| 4,211,141 | 6/1980 | Jensen et al. | 84/721 |
| 5,052,268 | 10/1991 | Clark, Jr. | 84/626 |
| 5,097,741 | 3/1992 | Kikumoto | 84/626 |
| 5,166,467 | 11/1992 | Brown | 84/721 |

*Primary Examiner*—Vit W. Miska
*Attorney, Agent, or Firm*—Graham & James

[57] ABSTRACT

A foot pedal control system incorporated in an electrical musical keyboard instrument is expected to decide an output signal of a foot control pedal unit to be either analog or digital signal on the basis of a series of discrete voltage levels through periodical sampling on the output signal, and a microcomputer system of the foot pedal control system executes a program sequence for periodically monitoring the discrete voltage level, deciding the digital signal to be either analog or digital signal and determining an instruction of a player represented by the output signal.

6 Claims, 5 Drawing Sheets

FOOT PEDAL CONTROL SYSTEM INCORPORATED IN MUSICAL INSTRUMENT AND SHARED BETWEEN ANALOG SIGNAL AND DIGITAL SIGNAL

FIELD OF THE INVENTION

This invention relates to a musical instrument and, more particularly, to a musical instrument such as a keyboard instrument equipped with a foot pedal system.

DESCRIPTION OF THE RELATED ART

An electric keyboard instrument such as an automatic player piano is equipped with not only a keyboard implemented by black and white keys but also a foot pedal control system, and a player selectively depresses the black and white keys and steps on the foot control pedals so that the automatic player piano sequentially produces sounds for a music.

The foot control pedals are broken down into two categories, i.e., an analog type and a digital type. Each of the foot control pedals of the analog type produces a continuously variable signal indicative of, for example, a tempo of a music, and a foot control pedal of the digital type produces an output signal shifted between two discrete values corresponding to a start and a finish of an operation, by way of example. Thus, the foot control pedals are different in electric function, and two interfaces are provided between the foot control pedals and a signal processing unit.

However, a problem is encountered in the prior art keyboard instrument in production cost due to complexity of the foot pedal control system as well as to noncompatibility between the two types of foot control pedal. In detail, the foot control pedals of the analog type and the foot control pedals of the digital type require respective bus systems, respective interfaces and so fourth, and these bus systems and the interfaces are exclusively used for the analog signals and the digital signals. This means that the prior art keyboard instrument is equipped with two independent electric sub-systems, and the two independent electric sub-systems make the prior art keyboard instrument complex.

Moreover, the foot control pedals of the analog type are arranged in such a manner as to produces output signals continuously variable, and are different in structure from the foot control pedals of the digital type for producing output signals with two discrete values. This means that the foot control pedals of the analog type can not be available for the digital output signals, and there is not any compatibility between the foot control pedals of the analog type and the foot control pedals of the digital type.

The complexity increases the number of components of the keyboard instrument as well as time and labor for assembling work. Moreover, the poor compatibility increases the kinds of stock, and an requires carefulness to the assembly workers. Such a careful assembling work consumes time. As a result, the prior art keyboard instrument fabricated under such undesirable circumstances is increased in production cost.

SUMMARY OF THE INVENTION

It is therefore an important object of the present invention to provide a musical instrument which is reduced in production cost.

To accomplish the object, the present invention proposes to periodically check an output voltage level of a foot control pedal unit for discriminating the type of a foot control pedal.

In accordance with the present invention, there is provided a foot pedal controlling system incorporated in a musical instrument, comprising: a) a foot control pedal unit manipulated by a player for producing either analog or digital signal from a power voltage level; b) a socket unit coupled with the foot control pedal unit in a detachable manner, and operative to supply the power voltage level to the foot control pedal unit and to receive aforesaid either analog or digital signal; c) a digital signal producing means coupled with the socket unit, and periodically producing a digital input signal indicative of a discrete voltage level of aforesaid either analog or digital signal at every sampling timing; d) a voltage variation monitoring means operative to check the digital input signal to see whether aforesaid either analog or digital signal is varied abruptly or gradually, and producing a piece of historical information indicative of either abrupt or gentle variation; e) a discriminating means operative to decide the foot control pedal unit to be of either analog or digital type on the basis of the piece of historical information; and f) a determining means operative to decide an instruction of the player represented by aforesaid either analog or digital signal for producing an digital output signal.

BRIEF DESCRIPTION OF THE DRAWINGS

The features and advantages of the musical instrument according to the present invention will be more clearly understood from the following description taken in conjunction with the accompanying drawings in which.

DESCRIPTION OF THE PREFERRED EMBODIMENT

Figure 1:
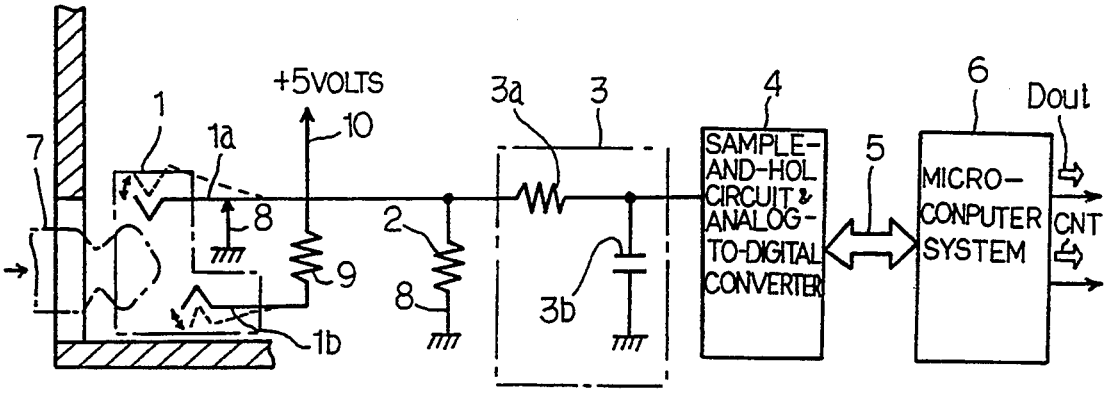
FIG. 1 is a circuit diagram showing a foot pedal control system according to the present invention.

Referring to FIG. 1 of the drawings, a foot pedal control system embodying the present invention comprises a socket 1, a pull-down resistor 2, a protection circuit 3 and an analog-to-digital converter 4, and the analog-to-digital converter 4 is coupled through a bus system 5 with a microcomputer system 6.

The socket 1 is formed by spring members 1*a* and 1*b*, and the spring members 1*a* and 1*b* are elastically deformed when a jack 7 is inserted therein. While the jack 7 is inserted into the socket 1, the spring member 1*a* is released from a ground voltage line 8, and the socket 1 is changed from "released state" to "coupled state". The other spring member 1*b* is coupled through a resistor 9 with a power voltage line 10 at all times, and positive power voltage at 5 volts is applied to the power voltage line 10.

The pull-down resistor 2 is coupled between the spring member 1*a* and the ground voltage line 8, and the protection circuit 3 is coupled between the spring member 1*a* and the analog-to-digital converter 4. The protection circuit 3 is implemented by a resistor 3*a* and a capacitor 3*b*, and the resistor 3*a* and the capacitor 3*b* respectively protects the analog-to-digital converter 4 from a surge and noises. In this instance, the resistor 3*a* is adjusted to 100 ohms.

The analog-to-digital converter 4 contains a sample-and-hold circuit periodically sampling an input voltage level Vin at every 4 milliseconds, and converts the input voltage level Vin ranging between zero to 5 volts into an eight-bit digital signal. The analog-to-digital converter 4 is communicable through the bus system 5 with the microcomputer system 6, and the eight-bit digital signal is fetched by the microcomputer system 6 at every 4 milliseconds.

The microcomputer system 6 comprises a central processing unit, a program memory implemented by read only memory devices and a working memory implemented by random access memory devices. Various tasks are assigned to the microcomputer system 6, and one of the tasks is an automatic discrimination on a foot control pedal unit coupled with the socket 1, i.e., either analog or digital type. Another task is to produce a digital data signal Dout and a digital control signal CNT from the eight-bit digital signal, and the digital data signal Dout and the digital control signal CNT are indicative of the magnitude of voltage produced with the foot control signal of the analog type and one of the two states of the foot control pedal of the digital type. The automatic discrimination followed by the production of digital signal will be described in detail hereinlater.

Figure 2:
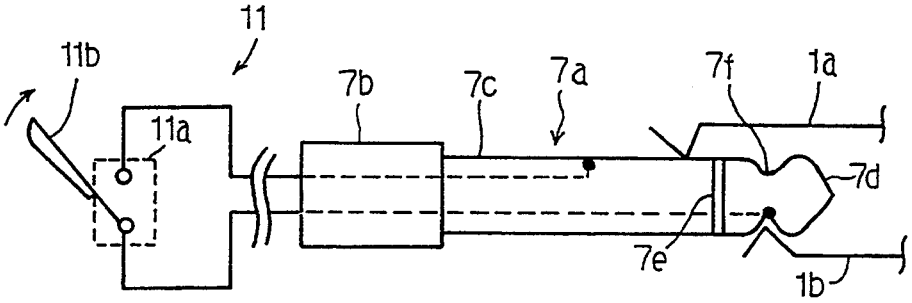
FIG. 2 is a front view showing a jack connectable with a foot control pedal of a digital type.

There are two kinds of jack 7 capable of insertion into the socket 1, and the dimensions are equal to one another. A jack 7*a* shown in FIG. 2 is connectable with a foot control pedal unit 11 of the digital type, and has a connector 7*b*, a boss portion 7*c* projecting from the connector 7*b* and a leading end portion 7*d* electrically isolated from the boss portion 7*c* by means of an insulating ring 7*e*. A constriction 7*f* is formed in the leading end portion 7*d*, and the boss portion 7*c* and the leading end portion 7*d* are electrically coupled with a switching element 11*a* of the foot control pedal unit 11. The switching element 11*a* is connected with a foot control pedal 11*b*, and a player steps on the foot control pedal 11*b* so that the switching element 11*a* electrically conducts the boss portion 7*c* with the leading end portion 7*d*.

While the jack 7*a* is inserted into the socket 1, the spring member 1*a* is held into contact with the outer surface of the boss portion 7*c*, and the spring member 1*b* is received into the constriction 7*f*. As a result, the spring member 1*a* is deformed so as to be left from the ground voltage line 8, and the positive voltage at 5 volts is applied through the spring member 1*b* to the leading end portion 7*d*. The positive voltage reaches the switching element 11*a*, and the switching element 11*a* transfers the positive voltage to the boss portion 7*c* when the player steps on the foot control pedal 11*b*. The positive voltage is propagated through the spring member 1*a* and the protection circuit 3 to the analog-to-digital converter, and the analog-to-digital converter 4 produces the eight-bit digital signal indicative of either on or off state of the switching element 11*a*.

Figure 3:
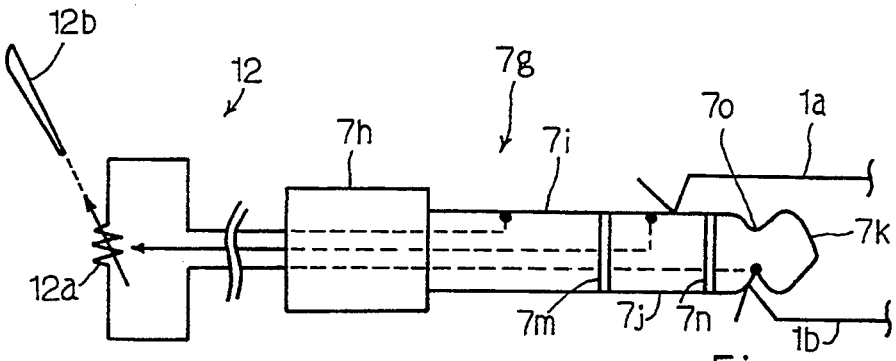
FIG. 3 is a front view showing another jack connectable with a foot control pedal of an analog type.

Turning to FIG. 3 of the drawings, another jack 7*g* has a connector 7*h*, a boss portion 7*i*, an intermediate portion 7*j* and a leading end portion 7*k*, and the boss, intermediate and leading end portions 7*i*, 7*j* and 7*k* are electrically isolated from one another by means of insulating rings 7*m* and 7*n*. A constriction 7*o* is formed in the leading end portion 7*k*, and the boss, intermediate and leading end portions 7*i*, 7*j* and 7*k* are electrically coupled with a foot control pedal unit 12. The foot pedal unit 12 has a variable resistor 12*a* coupled with the boss, intermediate and leading end portions 7*i*, 7*j* and 7*k*, and the resistance is variable with a foot control pedal 12*b*.

The total length of the boss, intermediate and leading end portions 7*h*, 7*i*, 7*j* and 7*k* is equal to the total length of the boss and leading end portions 7*c* and 7*d*, and the constrictions 7*f* and 7*o* are spaced from the leading ends by a predetermined distance. For this reason, while the jack 7*g* is inserted into the socket 1, the spring member 1*a* is held in contact with the intermediate portion 7*j*, and the spring member 1*b* is received in the constriction 7*o*.

Figure 4:
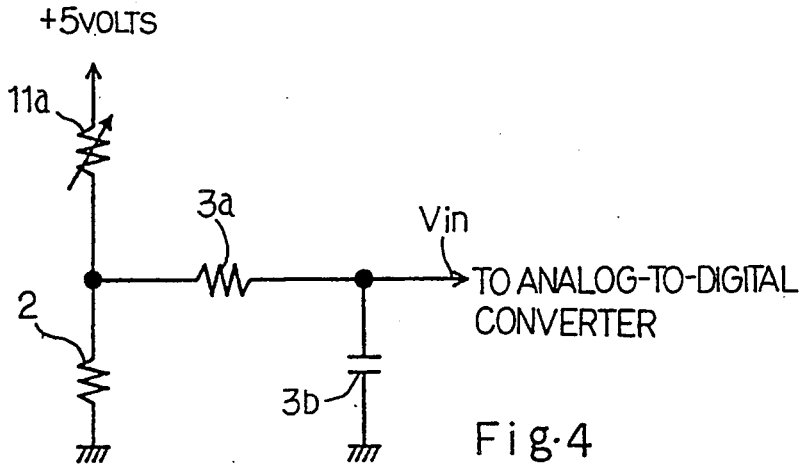
FIG. 4 is a circuit diagram showing the equivalent circuit of the jack of the analog type coupled with the socket.
Figure 5:
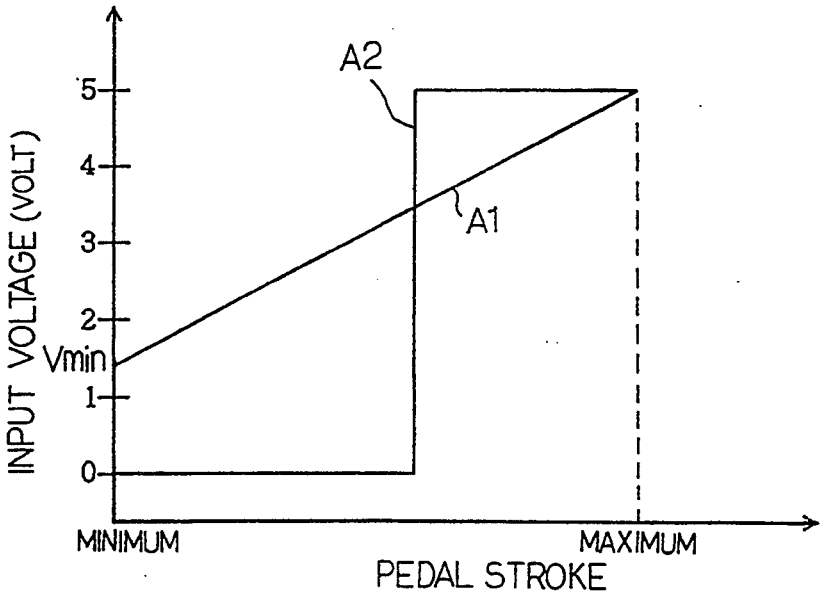
FIG. 5 is a diagram showing relation between the pedal stroke and an output voltage level at the input node of an analog-to-digital converter incorporated in the foot pedal control system.

FIG. 4 illustrates an equivalent circuit of the foot pedal control system coupled with the jack 7*g*, and a series of the variable resistor 12*a* and the pull-down resistor 2 is coupled between the power voltage line 10 and the ground voltage line 8. Since the pull-down resistor 2 provides resistance much larger than the resistance at the full stroke of the foot control pedal 12*b*, the input voltage level Vin at the analog-to-digital converter 4 is linearly increased depending upon the position of the foot control pedal 12*b*, and trances Plots A1 of FIG. 5. On the other hand, the input voltage level Vin at the minimum stroke is given by Equation 1.

$$Vmin = 5 \times R2/(R2 + R3a) \qquad \text{Equation 1}$$

where Vmin is the input voltage Vin at the minimum stroke, R2 is resistance of the pull-down resistor 2 and R3*a* is resistance of the resistor 3*a*.

On the other hand, the switching element 11*b* causes the input voltage level Vin to be abruptly changed, and the input voltage level Vin traces Plots A2.

Figure 6A:
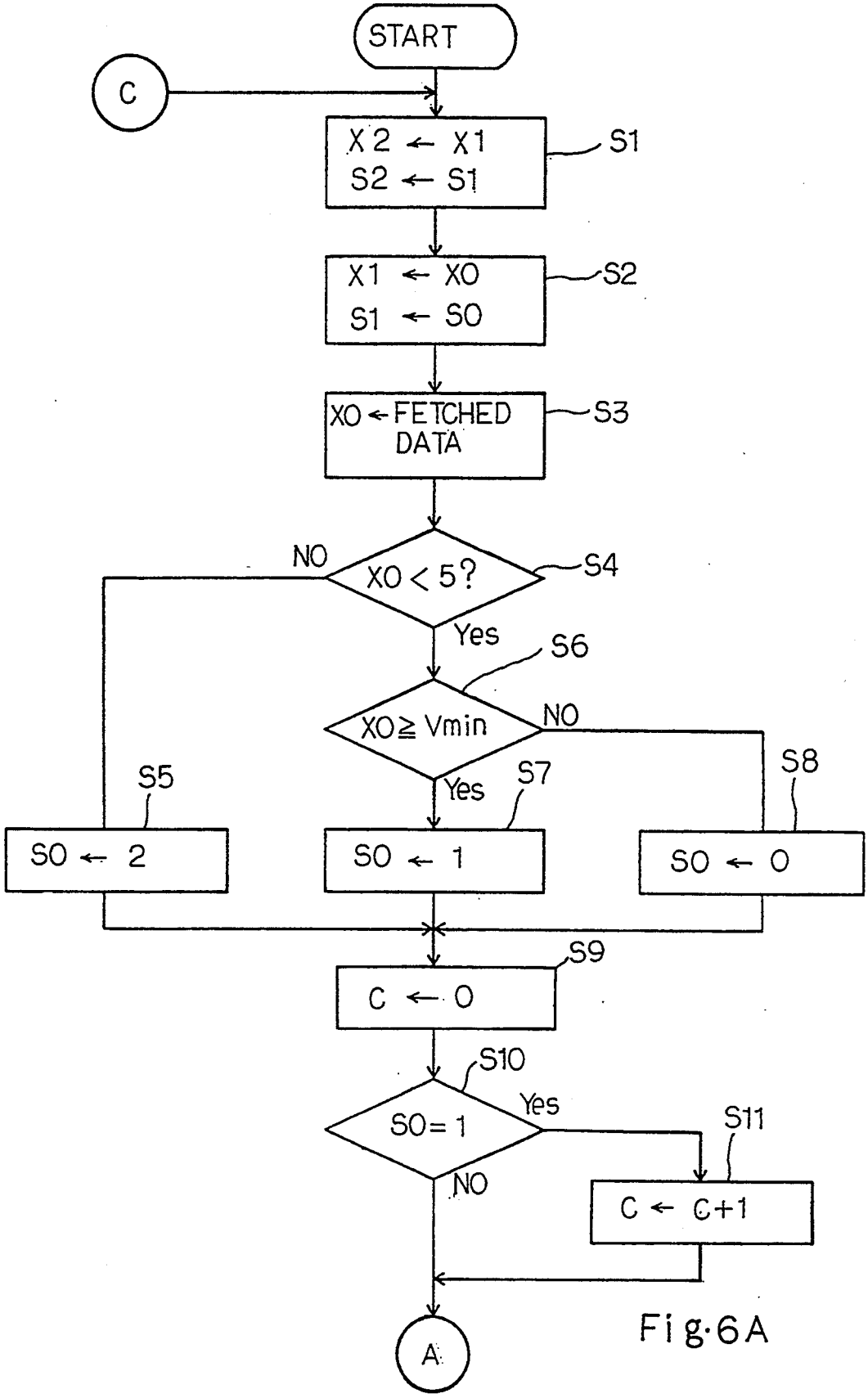
FIGS. 6A to 6C are flow charts showing an automatic discrimination sequence executed by the foot pedal control system.
Figure 6B:
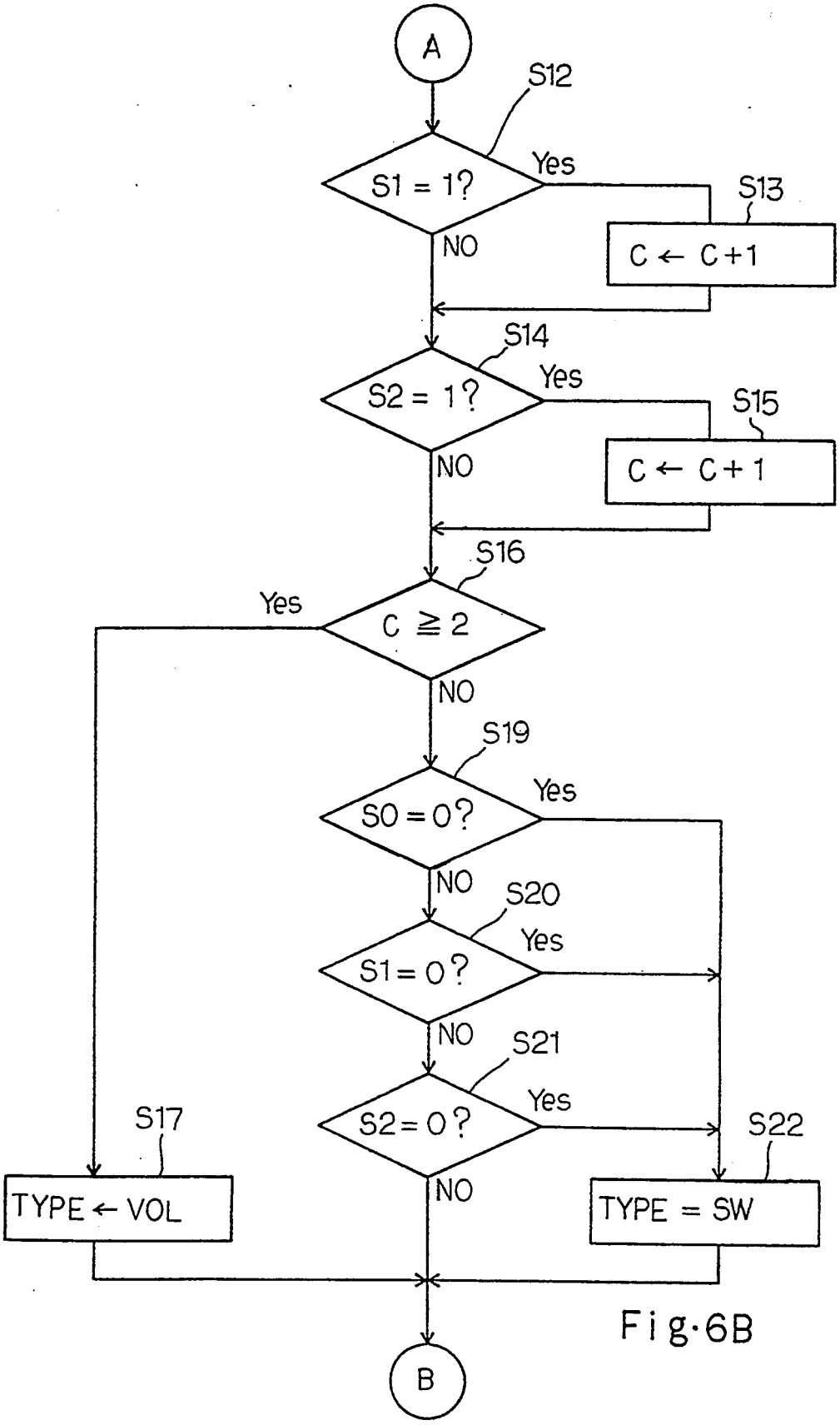
Figure 6C:
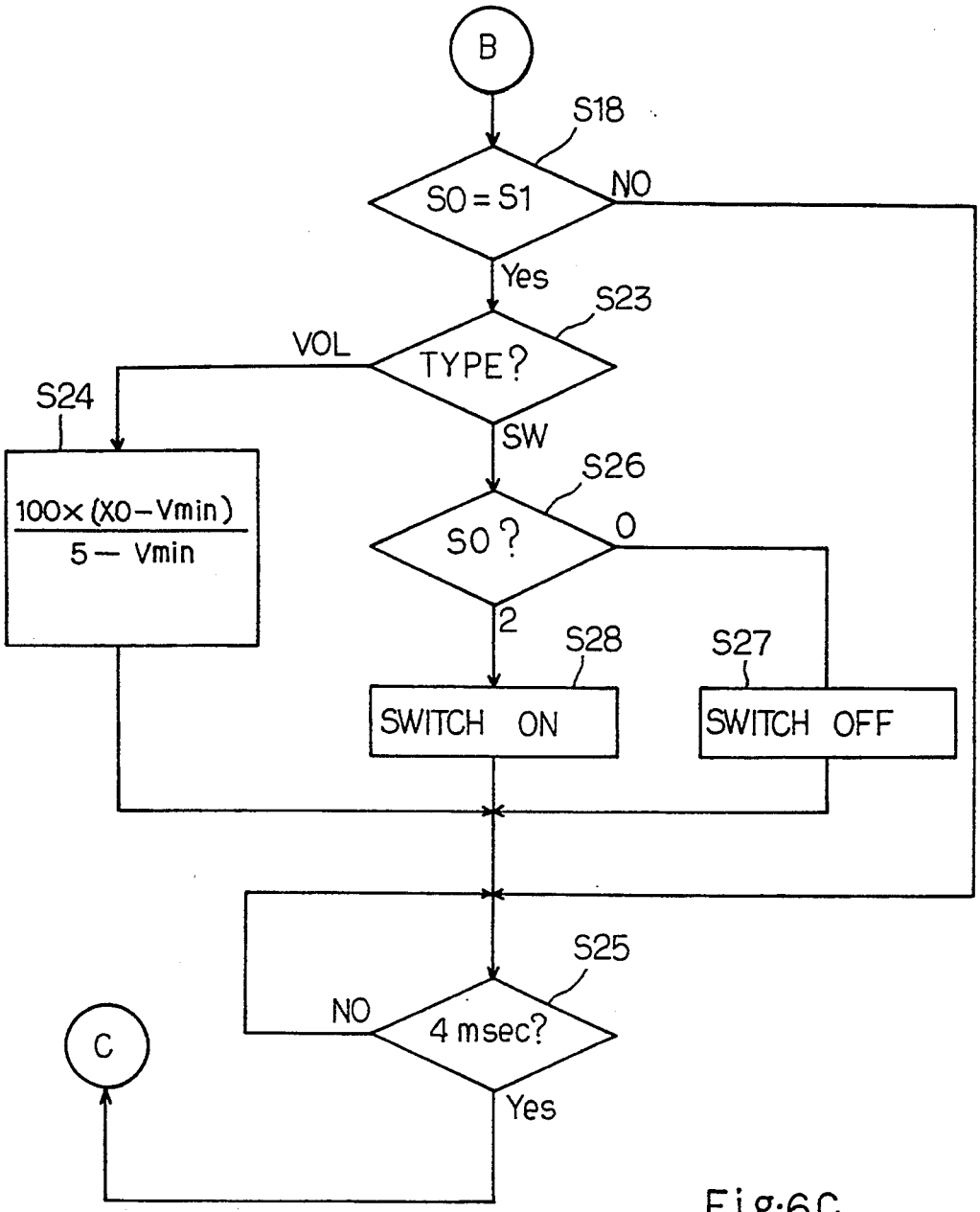

Description is hereinbelow made on the automatic discrimination sequence followed by the production of digital signal with reference to FIGS. 6A to 6C. In the flow charts shown in FIGS. 6A to 6C, X0 is indicative of a discrete voltage level indicated by the eight-bit digital signal at a standard time, X1 is indicative of a discrete voltage level of the eight-bit digital signal 4 milliseconds before the standard time, and X3 is indicative of a discrete voltage of the eight-bit digital signal 8 milliseconds before the standard time.

S0 is a status signal set to either 0, 1 or 2 depending upon the discrete voltage level X0. If the discrete voltage level V0 is equal to or greater than 5 volts, the status signal S0 is set to 2. The discrete voltage level V0 less than Vmin causes the status signal S0 to be set to 0, and the status signal S0 at "1" is indicative of the discrete voltage level V0 not less than Vmin and less than 5 volts. Similarly, S1 and S2 are indicative of status signals set to either 0, 1 or 2 depending upon the discrete voltage levels X1 and X2, respectively. The value of said status signal S0 may be determined through sequential comparison with threshold levels.

C is indicative of a value stored in a counter incorporated in the microcomputer system 6, and the value C is incremented with the status signals S0 to S2. The type of foot control pedal is discriminated with the value C.

The automatic discriminating sequence starts with data fetch from the analog-to-digital converter 4, and the data fetch is repeated at the predetermined intervals of 4 milliseconds. During the periodical data fetch, the discrete voltage level X1 and the value of the status signal S1 are saved for the discrete voltage level X2 and the status signal S2, respectively, as by step S1, and the discrete voltage level X0 and the value of the status signal S0 are respectively saved for the discrete voltage level X1 and the status signal S1 as by step S2. After the sequential saving, the value of the eight-bit digital signal is stored as the discrete voltage level X0 as by step S3.

Subsequently, the microcomputer system 6 proceeds to step S4, and checks the discrete voltage level X0 to see whether or not the value of the discrete voltage level X0 is less than "5". If the answer to the step S4 is negative, the discrete voltage level X0 is equal to or greater than 5 volts, and the microcomputer system 6 gives value "2" to the status signal S0 as by step S5.

However, if the answer to the step S4 is given affirmative, the microcomputer system 6 checks the discrete voltage level X0 again to see whether or not the discrete voltage level X0 is equal to or greater than the input voltage level Vmin at the minimum stroke as by step S6. If the answer to the step S6 is given affirmative, the discrete voltage level X0 is not less than the input voltage level Vmin, and the microcomputer system 6 gives value "1" to the status signal S0 as by step S7. On the other hand, if the answer to the step S6 is given negative, the discrete voltage level X0 is less than the input voltage level Vmin, and the microcomputer system 6 gives value "0" to the status signal S0 as by step S8.

After either step S5, S7 or S8, the microcomputer system 6 proceeds to step S9, and initializes the counter. As a result, the value C is set to "0". The microcomputer system 6 proceeds to step S10, and checks the status signal S0 to see whether or not the status signal S0 is equal to 1. If the answer to the step S10 is given affirmative, the foot control pedal unit 11 or 12 is increasing the input voltage level Vin along either Plots A1 or A2, and the microcomputer system 6 increments the value C as by step S11. After the step S11, the microcomputer system 6 proceeds to step S12. However, if the answer to the step S10 is given negative, the microcomputer system S11 increments the value C stored in the counter as by step S11, and, then, proceeds to step S12.

In the step S12, the microcomputer 6 checks the status signal S1 to see whether to be 1 or not. If the answer to the step S12 is given affirmative, the microcomputer system 6 increments the value C of the counter as by step S13, and proceeds to step S14. However, if the answer to the step S12 is given negative, the microcomputer system 6 directly proceeds to the step S14.

In the step S14, the microcomputer system 6 checks the status signal S2 to see whether to be 1 or not. If the answer to the step S14 is given affirmative, the microcomputer system 6 increments the value C of the counter as by step S15, and proceeds to step S16. However, if the answer to the step S14 is given negative, the microcomputer system 6 directly proceeds to the step S16.

Upon completion of the step S15, a piece of historical information is stored in the counter in the form of numerical value C. If the value C is "1", the input voltage level Vin is abruptly changed, because the discrete voltage level X1 at only 4 millisecond before the last sampling indicates that the foot pedal remains in the minimum stroke. On the other hand, if the value C is equal to or greater than "2", the historical information teaches that the discrete voltage level is gradually increased, because the discrete voltage level X1 indicates that the input voltage level Vin is still on the way to the maximum value or the minimum value.

The microcomputer system checks the counter to see whether or not the value C is equal to or greater than "2" as by step S16. If the answer to the step S16 is given affirmative, the microcomputer system 6 decided the foot control pedal to be of the analog type, and writes "VOL" into a predetermined resistor TYPE. The index "VOL" is indicative of the analog type. Then, the microcomputer system 6 proceeds to step S18.

On the other hand, if the answer to the step S16 is given negative, the microcomputer system 6 sequentially checks the status signals S0, S1 and S2 to see whether or not the status signals S0 to S2 are equal to zero as by steps S19 to S21. If at least one of the status signals S0 to S2 is zero, the status signals S0 to S2 teaches that the foot control pedal has been moved, and the answer to at least one of the steps S19 to S21 is given affirmative. Then, index "SW" is written into the predetermined register TYPE as by step S22, and the microcomputer system proceeds to step S18. The index "SW" is indicative of the digital type. However, if all of the answers to the steps S19 to S21 are given negative, the status signals S0 to S2 teach that the foot control pedal just starts moving, and the microcomputer system 6 directly proceeds to the step S18 without any decision-making.

In the step S18, the microcomputer system 6 checks the status signals S0 and S1 to see whether or not the status signal S0 is equal to the status signal S1. If the answer to the step S18 is given affirmative, the foot control pedal terminates at an appropriate position indicative of a player's instruction, and the microcomputer system 6 checks the predetermined register TYPE to see whether the index stored therein is indicative of the analog type VOL or the digital type SW. If the index is indicative of the analog type, the microcomputer system 6 calculates the voltage level at the terminal position of the foot pedal as by step S24, and produces a digital data signal Dour indicative of the player's instruction. repeats step S25 until 4 milliseconds lapses.

On the other hand, the index is indicative of the digital type, the microcomputer system 6 checks the status signal S0 to see whether to be "0" or "2". If the status signal S0 is zero, the foot control pedal reaches the minimum stroke, and the switching element turns off. Then, the microcomputer system decides the switching element to turn off as by step S27, and produces a digital control signal CNT indicative of the off-state. If the status signal S0 is "2", the foot control pedal reaches the maximum stroke, and the microcomputer system 6 decodes the switching element to turn on as by step S28. Then, the microcomputer system 6 produces the digital control signal indicative of the on-state.

However, if the answer to the step S18 is given negative, the foot control pedal is still moving, and the microcomputer system 6 directly proceeds to the step S25.

After 4 milliseconds lapses, the microcomputer system 6 returns to the step S1, and repeats the loop consisting of the steps S1 to S28 until the player finishes the performance.

In this instance, the analog-to-digital converter 4 serves as a digital signal producing means, and the microcomputer system 6 and the steps S1 to S15 as a whole constitute a voltage variation monitoring means. The microcomputer system 6 further constitutes a discriminating means together with the steps S16, S17 and S19 to S22. A determining means is constituted by the microcomputer system 6 and the other steps S18 and S23 to S28.

As will be appreciated from the foregoing description, the foot pedal control system according to the present invention discriminates the type of the foot control pedal, and is shared between the foot control pedal of the analog type and the foot control pedal of the digital type. This results in simple arrangement, and the assembling work becomes easy. As a result, the production cost is effectively decreased.

Although the particular embodiment of the present invention has been shown and described, it will be obvious to those skilled in the art that various changes and modifications may be made without departing from the spirit and scope of the present invention. For example, the present invention is applicable to any musical instrument in so far as both analog and digital signals are processed for a music, and the interval of 4 millisecond is changeable depending upon the manipulability of the associated foot control pedal. Moreover, if a foot pedal control system is equipped with a plurality of sockets, the microcomputer system 6 may execute the program sequence for every socket in, for example, a time sharing manner.

What is claimed is:

1. A foot pedal controlling system incorporated in a musical instrument, comprising:

a) a foot control pedal unit manipulated by a player for producing either analog or digital signal from a power voltage level;

b) a socket unit coupled with said foot control pedal unit in a detachable manner, and operative to supply said power voltage level to said foot control pedal unit and to receive said either analog or digital signal;

c) a digital signal producing means coupled with said socket unit, and periodically producing a digital input signal indicative of a discrete voltage level of said either analog or digital signal at every sampling timing;

d) a voltage variation monitoring means operative to check said digital input signal to see whether said either analog or digital signal is varied abruptly or gradually, and producing a piece of historical information indicative of either abrupt or gentle variation;

e) a discriminating means operative to decide said foot control pedal unit to be of either analog or digital type on the basis of said piece of historical information; and f) a determining means operative to decide an instruction of said player represented by said either analog or digital signal for producing a digital output signal.

2. A foot pedal controlling system as set forth in claim 1, in which said foot control pedal unit is equipped with one of a variable resistor or a switching element coupled with a foot pedal.

3. A foot pedal controlling system as set forth in claim 1, in which said digital signal producing means comprises a sample-and-hold circuit for periodically sampling said either analog or digital signal, and an analog-to-digital converting circuit for converting a sampled discrete voltage level of said either analog or digital signal into said digital input signal.

4. A foot controlling system as set forth in claim 1, in which said voltage variation monitoring means stores a series of digital input signals indicative of discrete voltage levels at different sampling timings, sequentially compares said series of digital input signals with first threshold levels for determining the magnitude of each discrete voltage level, and maintains or increment a counter depending upon the magnitude of each discrete voltage level, a value stored in said counter being indicative of said piece of historical information.

5. A foot pedal controlling system as set forth in claim 1, in which said discriminating means compares said value stored in said counter with a second threshold for deciding said foot control pedal to be either analog or digital type.

6. A foot pedal controlling system as set forth in claim 1, in which said determining means calculates a voltage level at an end position of said foot control pedal if said foot control pedal is of said analog type, and decides to be on-state or off-state on the basis of the last discrete voltage level if the control pedal is of said digital type, said digital output signal being indicative of one of said voltage level at said end position, said on-state and said off-state.

* * * * *